US009535439B2

(12) United States Patent
Jain et al.

(10) Patent No.: US 9,535,439 B2
(45) Date of Patent: Jan. 3, 2017

(54) LDO CURRENT LIMIT CONTROL WITH SENSE AND CONTROL TRANSISTORS

(71) Applicant: Texas Instruments Incorporated, Dallas, TX (US)

(72) Inventors: Karan Singh Jain, Dallas, TX (US); Timothy Bryan Merkin, Richardson, TX (US); Susan Curtis, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 113 days.

(21) Appl. No.: 14/446,563

(22) Filed: Jul. 30, 2014

(65) Prior Publication Data

US 2015/0130434 A1 May 14, 2015

Related U.S. Application Data

(60) Provisional application No. 61/901,851, filed on Nov. 8, 2013.

(51) Int. Cl.

| | |
|---|---|
| ***G05F 1/575*** | (2006.01) |
| *G05F 1/10* | (2006.01) |
| *G05F 1/56* | (2006.01) |

(52) U.S. Cl.

CPC ..... *G05F 1/575* (2013.01); *G05F 1/10* (2013.01); *G05F 1/56* (2013.01)

(58) Field of Classification Search

CPC ..... G05F 1/10; G05F 1/08; G05F 1/56; G05F 1/569; G05F 1/571; G05F 1/573; G05F 1/618; G05F 1/468; G05F 1/575

See application file for complete search history.

(56) References Cited

U.S. PATENT DOCUMENTS

| | | | | |
|---|---|---|---|---|
| 6,700,361 | B2 * | 3/2004 | Gregorius | G05F 1/575 323/274 |
| 7,710,090 | B1 * | 5/2010 | Kimura | G05F 1/5735 323/276 |
| 2009/0001953 | A1 | 1/2009 | Huang | |
| 2009/0179622 | A1 * | 7/2009 | Ivanov | G05F 1/575 323/271 |
| 2009/0273323 | A1 * | 11/2009 | Kimura | G05F 1/575 323/265 |
| 2009/0322429 | A1 * | 12/2009 | Ivanov | H03F 3/45179 330/257 |
| 2010/0289472 | A1 * | 11/2010 | Renous | G05F 1/575 323/282 |
| 2012/0112717 | A1 | 5/2012 | Liu et al. | |
| 2013/0049722 | A1 | 2/2013 | Huang | |
| 2013/0082676 | A1 * | 4/2013 | Ivanov | H03F 3/3022 323/316 |
| 2015/0061622 | A1 * | 3/2015 | Bhattad | G05F 1/56 323/280 |
| 2015/0077076 | A1 * | 3/2015 | Bhattad | G05F 1/56 323/280 |

* cited by examiner

*Primary Examiner* — Gustavo Rosario Benitez
(74) *Attorney, Agent, or Firm* — Lawrence J. Bassuk; Frank D. Cimino

(57) ABSTRACT

A circuit and method for providing a current limiting feature in a low dropout ("LDO") linear voltage regulator. A pass element generates an output voltage that is less than the input voltage. The pass element is normally enabled by an error amplifier that compares a feedback signal from the output of the pass element with a reference signal. However, the pass element may be enabled by a current limiting circuit that bypasses the error amplifier to limit the current generated at the output of the pass element.

4 Claims, 7 Drawing Sheets

LDO CURRENT LIMIT CONTROL WITH SENSE AND CONTROL TRANSISTORS

CROSS-REFERENCE

This application claims priority from U.S. Provisional Patent Application No. 61/901,851 filed Nov. 8, 2013, entitled Fast Current Limiting Circuit in Multi Loop LDOs, which is incorporated herein by reference in its entirety.

TECHNICAL FIELD

This disclosure relates in general to electronic power supply circuits, and in particular, to a circuit and method for limiting current in a low dropout linear voltage regulator.

BACKGROUND

A linear voltage regulator is often used for providing stepped down power to electronic devices, particularly devices having low power or low noise requirements. The linear voltage regulator is easy to use and inexpensive to implement. However, it is extremely inefficient since the difference between a higher input voltage and a lower output voltage is dissipated as heat.

A low dropout regulator ("LDO") is a linear voltage regulator that operates with input voltage only slightly higher than the output voltage, and therefore is somewhat more efficient than a standard linear voltage regulator. The LDO regulator is particularly well-suited for low voltage applications. However, the load demand on a LDO regulator can change quickly, resulting in a temporary glitch on the output voltage. Most digital circuits do not react favorably to large voltage transients, and it would be desirable to avoid this issue.

A simplified block diagram of a typical LDO linear voltage regulator 100 is shown in FIG. 1. A pass element 130 takes an input voltage $V_{IN}$ and provides an output voltage $V_{OUT}$ under the control of an error amplifier 110. The output voltage $V_{OUT}$ is sampled as a feedback voltage signal $V_{FB}$ through a resistive divider $R_1$, $R_2$ in the output stage 140, and the feedback voltage signal $V_{FB}$ is coupled to the inverting input of the error amplifier 110. The non-inverting input of the error amplifier 110 is coupled to a reference voltage $V_{REF}$, which is usually derived from an internal bandgap reference 101. The error amplifier 110 compares the voltages at its inputs and operates to try and force the input voltages to be equal by sourcing current as required to meet the demand for load current by charging the output capacitor $C_{OUT}$.

At start up, the error amplifier 110 senses that the output voltage $V_{OUT}$ is low, and the pass element 130 is driven as hard as possible to meet the load requirement. The pass element 130 therefore pulls a large in-rush current to charge the output capacitance $C_{OUT}$, which is undesirable.

One solution to this problem is to employ a soft start circuit in the linear regulator to limit the initial power demand and thereby limit the current requirements at start up or turn on. However, such circuits cannot be readily optimized to provide a fast turn on of the system. Further, incorporating a current limiting circuit into a fast regulating LDO is a challenge because there are multiple feedback loops and making all loops stable can become challenging. Current limiting becomes even more critical if the LDO has an external capacitor since the capacitor requires limiting the in-rush current when the LDO is turned on.

Thus, it would be desirable to find an effective alternative current limiting solution for a multi loop LDO which can handle fast load transient while still regulating the LDO and providing protection from in-rush current and other excessive current demands.

DETAILED DESCRIPTION

This disclosure describes a low dropout ("LDO") linear voltage regulator circuit having a current limiting feature that limits in-rush current upon start-up and/or provides short circuit protection at the input while still having good load regulation.

Figure 1:
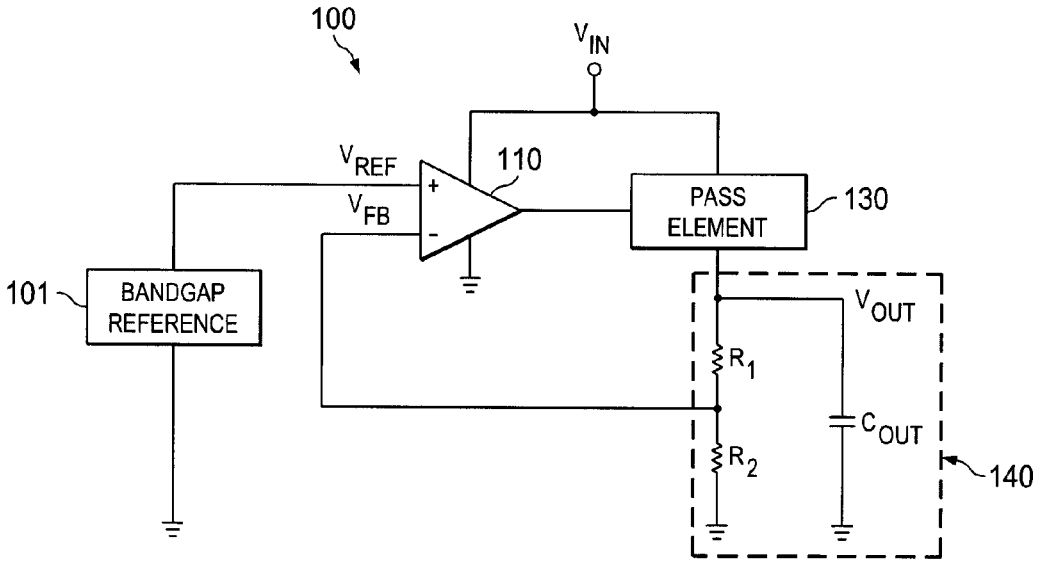
FIG. 1 (PRIOR ART)
FIG. 1 is a simplified circuit schematic of a conventional low dropout linear voltage regulator.
Figure 2:
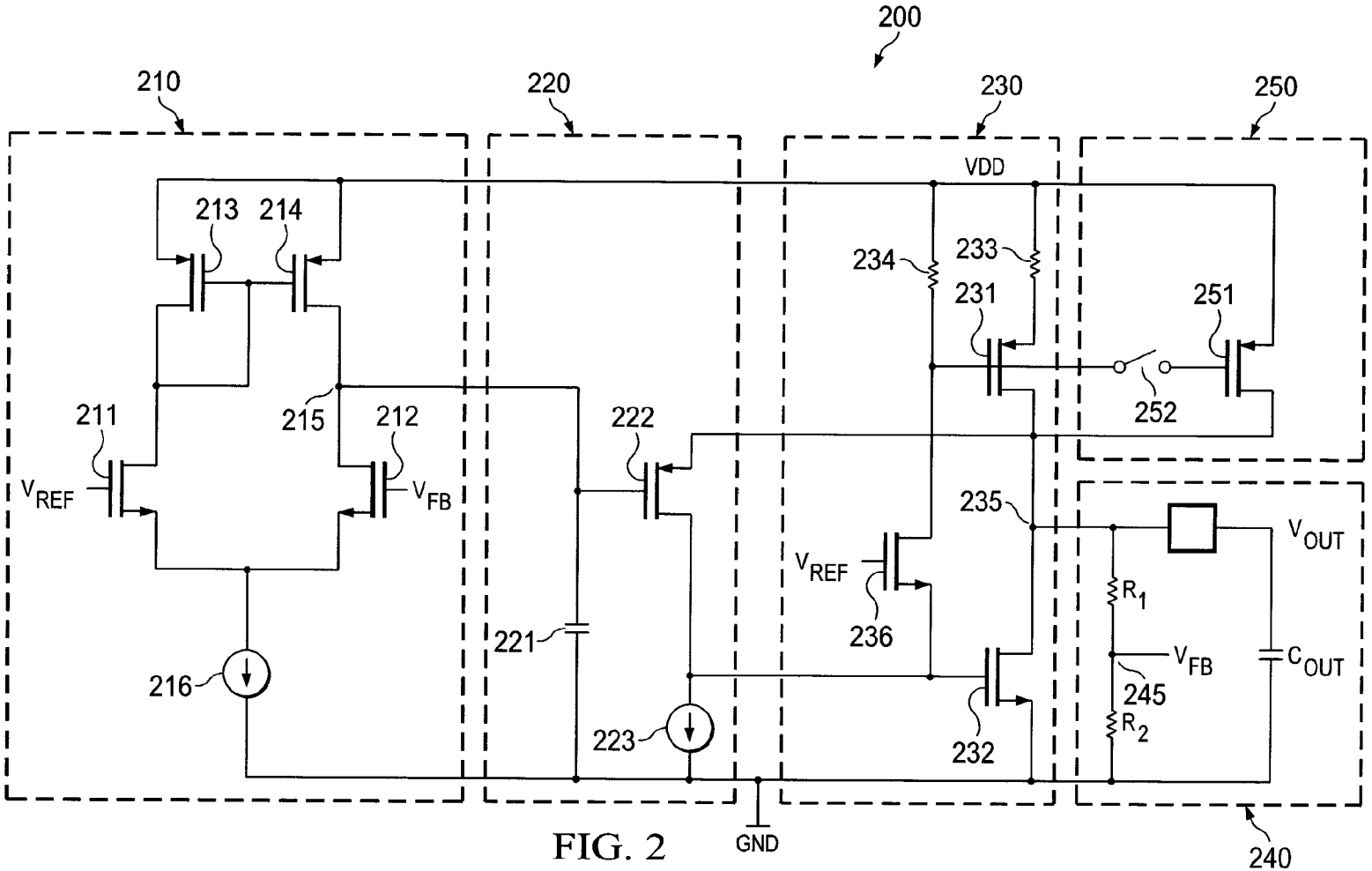
FIG. 2 (PRIOR ART)
FIG. 2 is a transistor level circuit schematic of a conventional low dropout linear voltage regulator.

In a conventional approach, a soft-start circuit is employed in an LDO regulator to prevent in rush current, as will now be described. For example, FIG. 2 illustrates a low dropout ("LDO") linear regulator 200 having a soft-start control circuit. A differential amplifier 210 functions as an error amplifier that compares a voltage reference signal $V_{REF}$, which is derived from an internal bandgap reference, with a voltage feedback signal $V_{FB}$, to generate a first control voltage signal at node 215. The voltage reference signal $V_{REF}$ is applied to the gate of load transistor 211 and the voltage feedback signal $V_{FB}$ is applied to the gate of load transistor 212. The drain of load transistor 211 is coupled to the drain of input transistor 213 and to the gates of both input transistors 213, 214. The drain of load transistor 212 is coupled to the drain of input transistor 214 at node 215. The source of each of the load transistors 211, 212 is coupled to a first current source 216, and the current source is coupled to a common reference, e.g., ground. The source of each of the input transistors 213, 214 is coupled to a supply voltage $V_{DD}$.

A source follower stage 220 includes a capacitor 221, a transistor 222, and a second current source 223. The capacitor 221 is coupled between node 215 and ground. The transistor 222 has its gate coupled to node 215, its source coupled to the output node 235, and its drain coupled to the second current source 223.

The pass element 230 includes a first power transistor 231 as the main pass gate on the high-side and a second power transistor 232 as the low-side pass gate coupled in series with the main pass gate. The drain of pass gate 231 is coupled with the drain of the pass gate 232 at node 235. The output voltage $V_{OUT}$ is generated at node 235. A resistor 233 is coupled between the source of pass gate 231 and the supply voltage $V_{DD}$. Another resistor 234 is coupled between the supply voltage $V_{DD}$ and the gate of the pass gate transistor 231. A transistor 236 has its drain coupled to resistor 234 and to the gate of pass gate 231. The source of transistor 236 is coupled to the drain of transistor 222 and the gate of low-side pass gate 232. The gate of transistor 236 is coupled to the voltage reference signal $V_{REF}$. Transistor 236 acts as a switch that feeds signals to the high-side pass gate 231 and the low-side pass gate 232.

The output stage 240 includes a resistive divider network having resistors $R_1$ and $R_2$ connected in series to the output node 235. The voltage feedback signal $V_{FB}$ is generated at node 245 and connected to the gate of input transistor 212.

The soft start circuit 250 includes transistor 251 and switch 252. For example, the switch 252 can be controlled by a digitally controlled timer (not shown) that closes the switch after a predetermined time. During start up, current initially flows through transistors 231 and 233 to generate the output voltage VOUT. However, when the switch 252 closes after the predetermined time, transistor 251 is enabled thereby helping to maintain voltage regulation at the output for larger currents.

The architecture shown in FIG. 2 has several drawbacks. For example, if brown out occurs, then the timer has to be re-started. This can become an issue in multi power domains. In addition, since the timer is fixed, only a limited amount of load can be powered, otherwise the in-rush current could be quite significant. This limits the load capacitance which may be required for different applications. Finally, some system behaviors may not be readily evident and/or perceived, and therefore there may be a condition where the output is shorted. This can lead to significantly higher currents, which can damage any electronic part in the system.

These problems can be overcome by incorporating a current limiting loop inside the LDO regulator where the current limiting loop has a higher bandwidth than the LDO regulator.

Figure 3A:
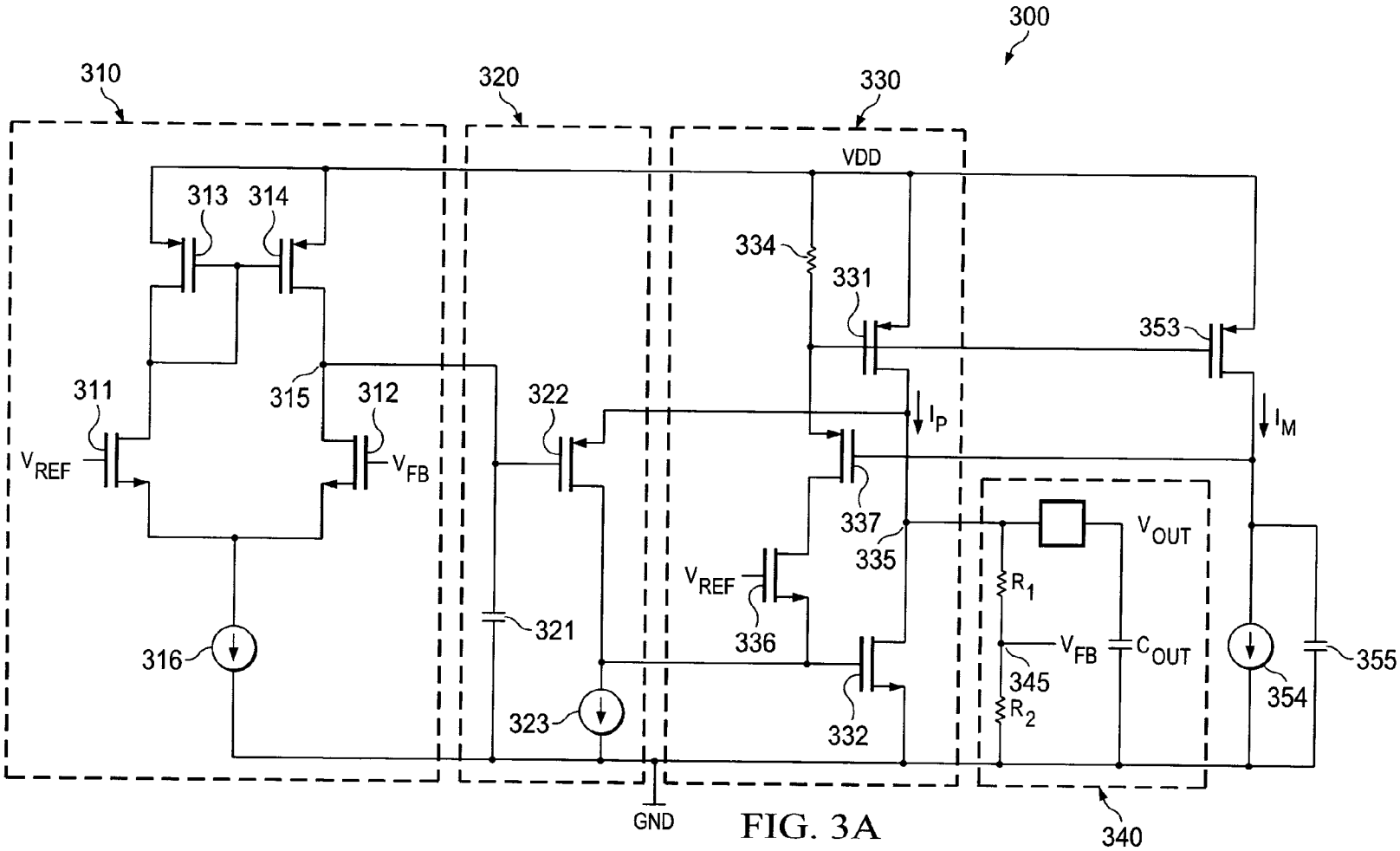
FIG. 3A is a transistor level circuit schematic of an improved low dropout linear voltage regulator.

Referring now to FIG. 3A, an LDO regulator 300 having a current limiting loop is illustrated. As in FIG. 2, the differential amplifier 310 functions as an error amplifier that compares voltage reference signal $V_{REF}$ with voltage feedback signal $V_{FB}$ to generate a control voltage signal at node 315. The voltage reference signal $V_{REF}$ is applied to the gate of load transistor 311 and the voltage feedback signal $V_{FB}$ is applied to the gate of load transistor 312. The drain of load transistor 311 is coupled to the drain of input transistor 313 and to the gates of both input transistors 313 and 314. The drain of load transistor 312 is coupled to the drain of input transistor 314 at node 315. The source of each of the load transistors 311, 312 is coupled to a first current source 316, and the current source is coupled to a common reference, e.g., ground. The source of each of the input transistors 313, 314 is coupled to a supply voltage $V_{DD}$.

The source follower stage 320 is the same as in FIG. 2, and includes a capacitor 321, a transistor 322, and a second current source 323. The capacitor 321 is coupled between node 315 and ground. The transistor 322 has its gate coupled to node 315, its source coupled to the output node 335, and its drain coupled to the second current source 323.

The pass element 330 includes a first power transistor 331 as the main pass gate on the high-side and a second power transistor 332 as the low-side pass gate coupled in series with the main pass gate. The drain of pass gate 331 is coupled with the drain of the pass gate 332 at output node 335, and is also connected to the source of transistor 322. A current $I_P$ is developed at the output node 335. A resistor 334 is coupled between the supply voltage $V_{DD}$ and the gate of the pass gate transistor 331.

An addition to the pass element 330 is transistor 337, which is added to control the current limiting loop. The source of transistor 337 is coupled to resistor 334 and to the gate of pass gate 331. The drain of transistor 337 is coupled to the drain of transistor 336. The gate of transistor 337 is coupled to the drain of transistor 353. The source of transistor 336 is coupled to the drain of transistor 322 and the gate of low-side pass gate 332. The gate of transistor 336 is coupled to the voltage reference signal $V_{REF}$.

As before, the output stage 340 includes a resistive divider network having resistors $R_1$ and $R_2$ connected in series to the output node 335, and an output capacitor $C_{OUT}$ coupled in parallel with the resistive divider network. The voltage feedback signal $V_{FB}$ is generated at node 345 and connected to the gate of input transistor 312.

Current limit control for the LDO 300 is provided by the sense transistor 353 in combination with current source 354 and capacitor 355. The sense transistor 353 has its drain coupled to the gate of control transistor 337, where a current $I_M$ is developed. The sense transistor 353 has its source coupled to the supply voltage $V_{DD}$, and its gate coupled to the gate of pass gate 331 and the source of transistor 337. The current source 354 is coupled between the drain of sense transistor 353 and ground, and develops a current $I_c$. The capacitor 355 is in parallel with the current source 354 between the drain of the sense transistor 353 and ground.

In the configuration of FIG. 3A, the sense transistor 353 is formed to be N times smaller than the pass gate transistor 331. Thus, the sense transistor 353 and pass gate 331 act like a current mirror, where:

$$I_M = \frac{I_P}{N}$$

The architecture illustrated in FIG. 3 helps actively reduce system level concerns, such as electron migration, reaction time to a short circuit condition, preventing a differential current dI/dt or voltage drop across the power supply, and providing in-rush protection.

Figure 3B:
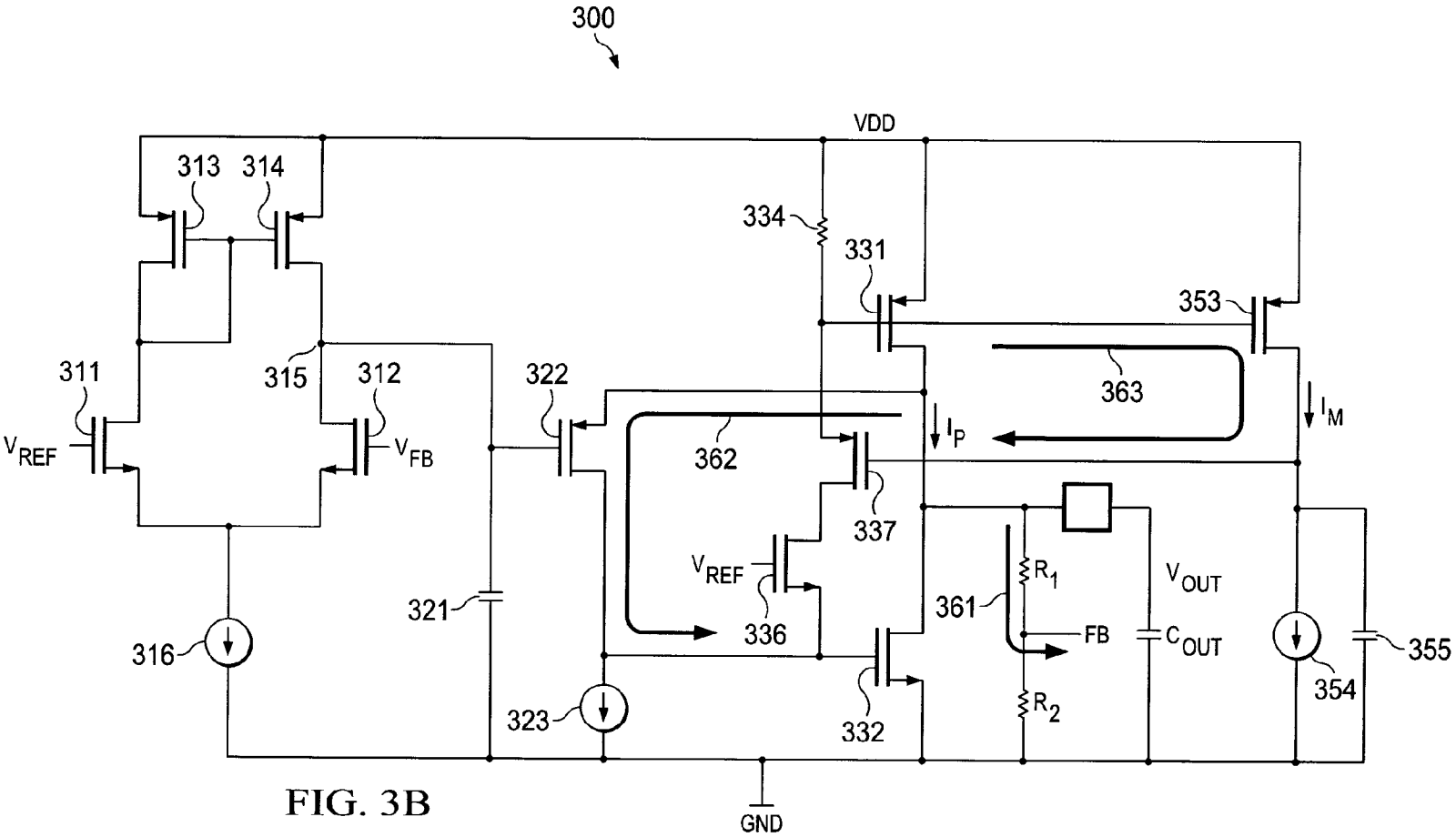
FIG. 3B is the circuit schematic of FIG. 3A illustrating a main loop, a fast loop, and a current limiting loop in the circuit.

In operation, the current limit control takes over the regulation function and starts to limit the current by controlling the gate of the control switch 337. For example, FIG. 3B illustrates the circuit 300 of FIG. 3A with reference arrow 361 indicating the main current loop for the LDO regulator 300, reference arrow 362 indicating the fast current loop for the LDO regulator, and reference arrow 363 indicating the current limiting loop for the LDO regulator. On start-up, the current is limited through sense transistor 353 as shown by reference arrow 363. This current drives the gate of control transistor 337 to operate in a fast loop mode, as indicated by reference arrow 362. Finally, the circuit reaches an equilibrium state where stable and normal operation proceeds in the main loop, as indicated by reference arrow 361.

Figure 4:
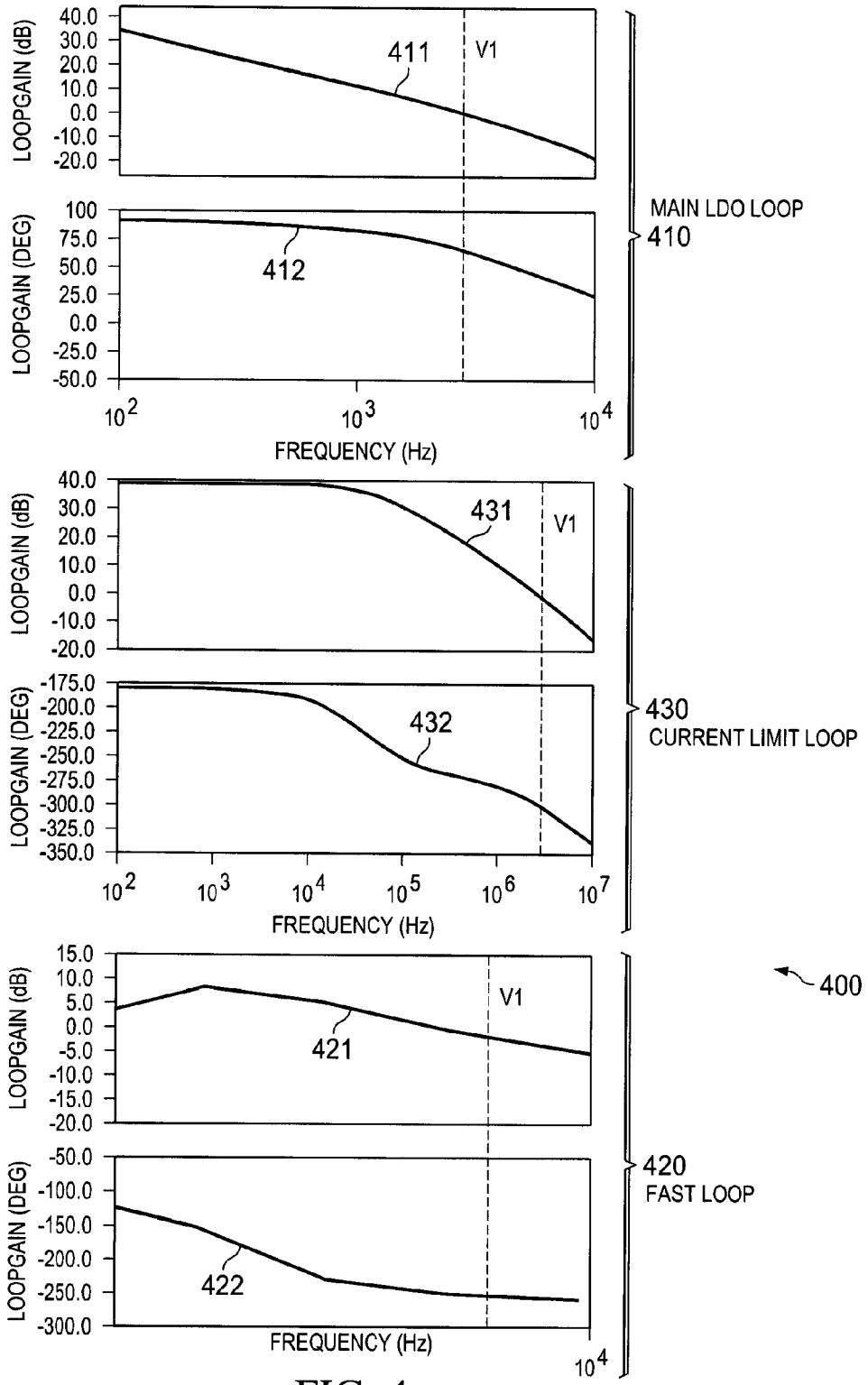
FIG. 4 is a series of graphs illustrating loop gain waveforms for the main loop, the fast loop, and the current limiting loop shown in FIG. 3B.

In order for the current limit control to be effective and the system stable, the current limit loop should have a higher bandwidth than the main loop or the fast control loop. This is illustrated by the graphs of loop gain versus frequency as shown in FIG. 4.

Graph 410 illustrates a plot of the loop gain versus the frequency in the main loop. The top waveform 411 shows the loop gain measured in decibels, which ranges from approximately +35 dB at $10^2$ Hz to approximately −20 db at $10^4$ Hz. The bottom waveform 412 shows the loop gain phase measured in degrees, which ranges from approximately +90 degrees at $10^2$ Hz to approximately +35 degrees at $10^4$ Hz.

Graph 420 illustrates a plot of the loop gain versus the frequency in the fast loop. The top waveform 421 shows the loop gain measured in decibels, which ranges from approximately +10 dB at 400 Hz to approximately −5 db at $10^4$ Hz. The bottom waveform 422 shows the loop gain phase measured in degrees, which ranges from approximately −160 degrees at 400 Hz to approximately −260 degrees at $10^4$ Hz.

Graph 430 illustrates a plot of the loop gain versus the frequency in the current limiting loop. The top waveform 431 shows the loop gain measured in decibels, which ranges from approximately +40 dB at $10^2$ Hz to approximately −12 db at $10^7$ Hz. The bottom waveform 432 shows the loop gain phase measured in degrees, which ranges from approximately −175 degrees at $10^2$ Hz to approximately −330 degrees at $10^7$ Hz.

Figure 5:
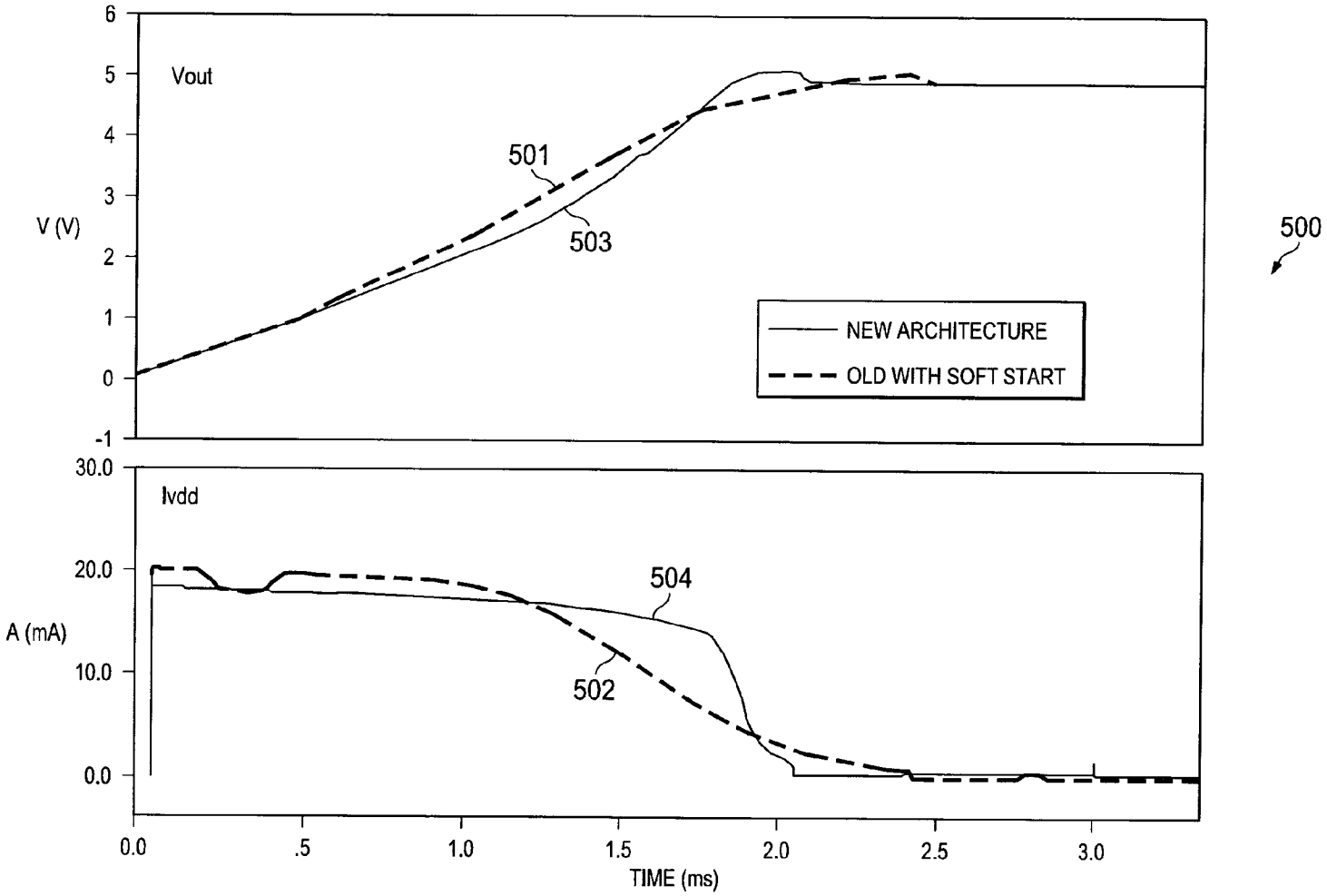
FIG. 5 is a graph illustrating a comparison of the output voltage and the in-rush current for the circuits of FIG. 2 and FIG. 3A.

FIG. 5 is a graph 500 illustrating a comparison of the output voltage $V_{OUT}$ and the input current $I_{VDD}$ for the circuits of FIG. 2 and FIG. 3A. Waveform 501 is the output voltage for the conventional circuit of FIG. 2, and waveform 502 is the input current for the circuit of FIG. 2. In contrast, waveform 503 is the output voltage for the improved circuit of FIG. 3A, and waveform 504 is the input current for the circuit of FIG. 3A. It can be seen that the current limiting circuit incorporated into the circuit 300 of FIG. 3A provides improved control of the in-rush current. This allows the start-up delay to be optimized for any circuit application.

Figure 6:
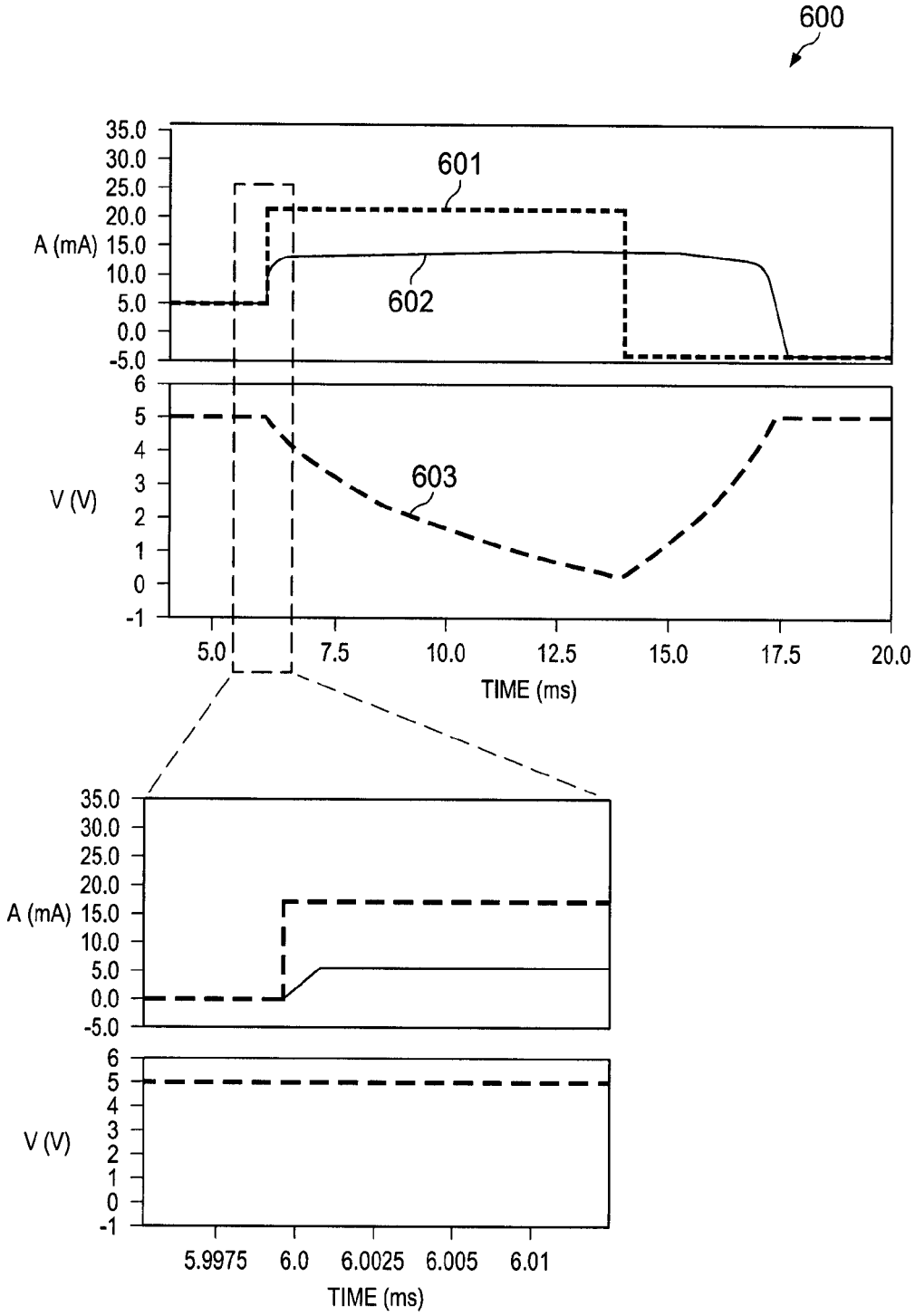
FIG. 6 is a graph illustrating output current and voltage over time.

FIG. 6 is a graph 600 illustrating the impact of the current limiting circuit of FIG. 3A. Waveform 601 represents the current $I_{OUT}$, which is taken at the output node 335. Waveform 602 represents the current that is limited by the LDO 300 because of the current limiting loop. Waveform 603 represents the voltage output $V_{OUT}$ of the LDO 300.

Since the output current of waveform 601 is greater in magnitude than the limited current of waveform 602, the remaining current is pulled from the output capacitor $C_{OUT}$ which discharges the output. Even if the electronic part browns out, or an excessive current is drawn out, then the current limiting circuit will kick in to limit the output current.

Although illustrative embodiments have been shown and described by way of example, a wide range of alternative embodiments is possible within the scope of the foregoing disclosure.

The invention claimed is:

1. A low drop out linear voltage regulator circuit comprising:

(a) a power lead and a ground lead;

(b) a source follower circuit having a source lead and a drain lead;

(c) an output stage having a regulated output lead;

(d) first and second pass transistors connected in series between the power lead and the ground lead, the regulated output lead and the source lead of the source follower circuit being connected between the pass transistors, each pass transistor having a gate, a source, and a drain, and the gate of the second pass transistor being connected to the drain lead of the source follower circuit;

(e) a control transistor and a reference transistor coupled in series between the power lead and the gate of the second pass transistor, the control transistor and the reference transistor each having a gate, a source, and a drain;

(f) a sense transistor having a source and a drain connected in series with a current source between the power lead and the ground lead, a gate of the sense transistor being connected with the gate of the first pass transistor, and the gate of the control transistor being connected between the sense transistor and the current source; and (g) a capacitor connected in parallel with the current source.

2. The circuit of claim 1 in which the gate of the reference transistor is connected to a reference voltage.

3. The circuit of claim 1 in which a current $I_m$ through the sense transistor is related to a current $I_p$ through the first pass transistor by the equation $I_m=I_p/N$, where N is the size of the sense transistor relative to the first pass transistor.

4. The circuit of claim 1 in which the source follower circuit includes a gate input lead, and including a differential amplifier circuit having a gate output lead connected to the gate input lead of the source follower circuit.

* * * * *